US005887367A

United States Patent [19]

Alvern

[11] Patent Number: 5,887,367

[45] Date of Patent: Mar. 30, 1999

[54] DISPLAY APPARATUS FOR A FLUID PUMP HAVING TWO PIVOTAL FRAME MEMBERS

[75] Inventor: Stein Alvern, Houston, Tex.

[73] Assignee: Alvern-Norway A/S, Oslo, Norway

[21] Appl. No.: 806,140

[22] Filed: Feb. 25, 1997

Related U.S. Application Data

[63] Continuation-in-part of Ser. No. 590,407, Jan. 25, 1996.

[51] Int. Cl.[6] ..... G09F 3/10

[52] U.S. Cl. ..... 40/299.01; 40/332; 222/23; 141/392; 141/98

[58] Field of Search ..... 40/661, 299, 310, 40/332, 299.01; 141/98, 396, 391, 397; 222/23, 173, 192

[56] References Cited

U.S. PATENT DOCUMENTS

| | | | |
|---|---|---|---|
| D. 173,006 | 9/1954 | Anderson . | |
| D. 173,007 | 9/1954 | Anderson . | |
| D. 279,483 | 7/1985 | Goldman . | |
| D. 279,484 | 7/1985 | Goldman . | |
| D. 366,310 | 1/1996 | Fell . | |
| 4,408,791 | 10/1983 | Griffin et al. . | |
| 4,465,209 | 8/1984 | Wilder . | |
| 4,690,182 | 9/1987 | Knaus . | |
| 4,790,088 | 12/1988 | Morvant | 40/779 X |
| 5,058,637 | 10/1991 | Fell . | |
| 5,184,309 | 2/1993 | Simpson et al. . | |
| 5,184,655 | 2/1993 | Fell . | |

FOREIGN PATENT DOCUMENTS

| | | |
|---|---|---|
| S-122642 | 2/1995 | Australia . |
| S-123343 | 5/1995 | Australia . |
| 0407271A1 | 1/1991 | European Pat. Off. . |
| 0608596A1 | 8/1994 | European Pat. Off. . |
| 62-208396 | 9/1987 | Japan . |
| 850627 | 10/1992 | Japan . |
| 1393062 | 5/1975 | United Kingdom . |
| 2147273 | 5/1985 | United Kingdom . |
| WO90/08375 | 7/1990 | WIPO . |
| WO 93/15493 | 8/1993 | WIPO . |

*Primary Examiner*—Cassandra H. Davis
*Attorney, Agent, or Firm*—Finnegan, Henderson, Farabow, Garrett & Dunner, L.L.P.

[57] ABSTRACT

A display apparatus is attachable to a fluid pump filler gun. The display apparatus comprises a first frame member and a second frame member opposite the first frame member, releasably engageable with one another to form a frame on the head portion of the filler gun. The gun head or protective body enclosing the gun head has an upper surface. Each first and second frame member releasably attaches to the gun head or protective body. A frame formed by the first and second frame members holds a replaceable message card between the frame and the upper surface. The first and second frame members can each hold additional replaceable message cards.

16 Claims, 17 Drawing Sheets

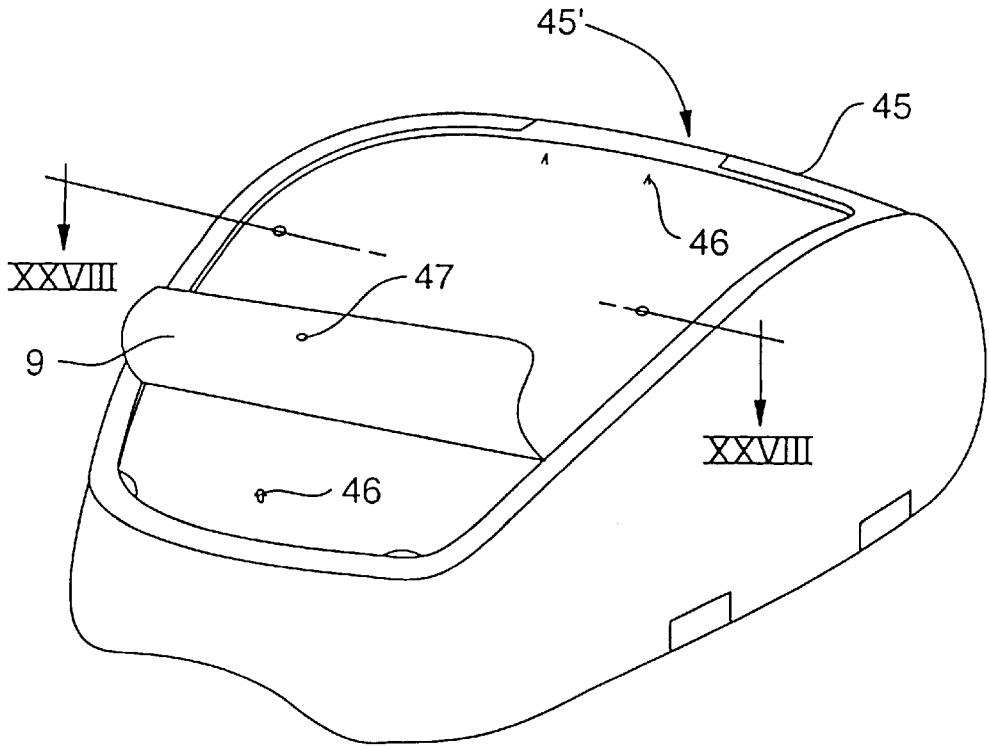
FIG. 27
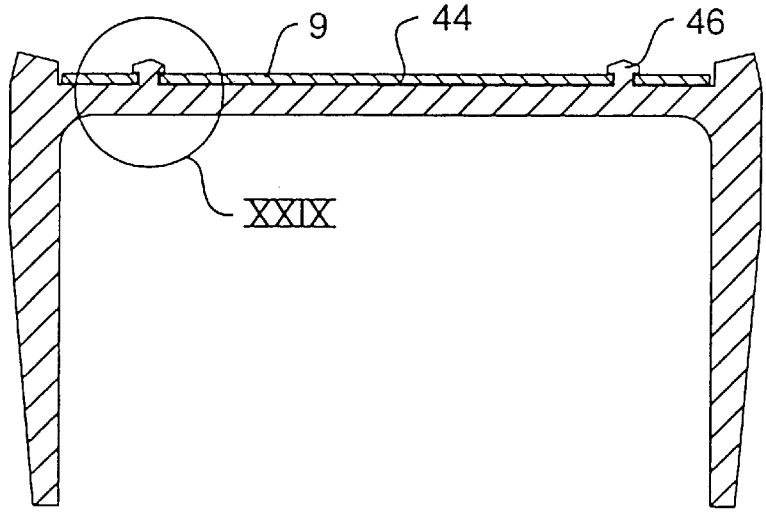
FIG. 28
FIG. 29
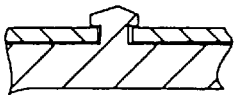

DISPLAY APPARATUS FOR A FLUID PUMP HAVING TWO PIVOTAL FRAME MEMBERS

This application is a continuation in part of U.S. patent application Ser. No. 08/590,407, filed Jan. 25, 1996.

FIELD OF THE INVENTION

The present invention relates to a display apparatus removably attachable to a fluid filler gun, e.g., of a fuel pump, oil pump, water pump or the like. The filler gun includes, in series connection, a nozzle having a forward discharge end and a rear end, a gun head having both a forward end portion which connects with the rear end of the gun nozzle and a rearward handle portion whose forward end connects to the rear end of the gun head. The display apparatus comprises a carrying body adapted to be fitted onto the filler gun and to extend from approximately a first junction between the rear end of the gun nozzle and the forward end of the gun head to approximately a second junction between the rear end of the gun head and a forward end of the handle. The carrying body has an upper surface defining an elongate display surface for messages.

The display apparatus is also useful on a filler gun having the gun head covered by a protective boot of rubber or plastic material.

BACKGROUND OF THE INVENTION

The prior art discloses a carrying body of the above mentioned type with the carrying body being shaped like a boot and having a rear end which is fully open for entry through the filler gun nozzle and the gun head, and a front end with a substantially smaller opening through which the filler gun nozzle extends when the carrying body is fitted onto the filler gun. A carrying body of such prior art type has an upper surface which effectively covers only the upper region of the gun head in order to define the elongate display surface for messages. Such carrying bodies are suitable for use in countries having only a very limited number of filler gun types, such as, for example, in Norway, Denmark, Germany and Sweden. However, in other areas of the world, the number of differently designed filler guns may be substantially higher. In the United States of America, for example, the number of differently shaped filler guns is in excess of ten. Such a large number of different types of filler guns requires a large number of differently made carrying bodies. In practice, it is difficult to obtain the same display surface area and configuration for each carrying body type. Also, some filler guns are so designed that they are difficult to design so as to be easily fitted and removed from a carrying body.

It is highly desirable to have a carrying body which is easily attachable to the filler gun even by an inexperienced person, and also to have a carrying body which is easily removable from the filler gun when maintenance is to be carried out on the filler gun, e.g. repair of the fuel valve within the filler gun head.

Most filler guns are known to have the gun head covered by a protective boot of rubber or plastic material, both for protecting the gun head against damage and to prevent a bare gun head from making scratches on a car's paint work. Removing such protective boot from a filler gun in order to mount a carrying body according to the present invention is both time consuming, resulting in a waste of the boot material, and causes the gun head to be less protected. The present invention therefore also includes the feature of being able to be fitted onto a filler gun without having to remove such protective boot.

According to a first embodiment of the present invention, the carrying body comprises a first member and a second member and means for releasably interconnecting the first and second members, the first and second members being shaped to generally conform, when so interconnected, to enclose the side, bottom, and upper portions of the gun head, and means pivotally connected to a top surface of the carrying body for supporting a replaceable message card placed on the display surface of the first member.

According to another embodiment of the present display apparatus, the carrying body comprises a lower member and an upper member releasably engageable with the lower member, the lower member having two side panels, a bottom element, and means connecting the side panels with the bottom element. The lower member, when the two side panels and the bottom element are brought to lie against the gun head, fits substantially around a lower part of the gun head. The side panels have at their top region a first interlocking means, the upper member being formed as a cap-like member to fit over an upper part of the gun head, and having a second interlocking means for releasably engaging the first interlocking means on the lower member, and a top member releasably engageable with the upper member. The top member has means for releasable engagement with the upper member, space being provided between an upper surface of the upper member and a portion of the top member for locating a replaceable message card when the top member and the upper member engage.

When the filler gun head is of the type already covered by a protective boot of rubber of plastic material, the carrying body can be fitted on the filler gun without having to remove the protective boot.

In a further embodiment of the display apparatus, the carrying body comprises a lower member and an upper member releasably or pivotally engageable with the lower member, and further a top member which is releasably engageable with the upper member. The top member has a curved configuration along its length.

According to a further embodiment of the display apparatus, the carrying body may comprise a lower member, an upper member releasably engageable with the lower member, the lower member having two side panels, a bottom element, and means connecting the side panels with the bottom element. The lower member, when the two side panels and the bottom element are brought to lie against the gun head, substantially surrounds a lower part of the gun head. The side panels have at their top regions a first interlocking means, and the upper member is formed as a cap-like means to fit over an upper part of the gun head, and having a second interlocking means for releasably engaging the first interlocking means onto the lower member. The upper member may have an upper (top) surface for locating a replaceable message card. The upper surface has along at least a portion of its peripheral edge an upwardly extending rim and means protruding up from the upper (top) surface for releasably engaging holes in the message card. This latter embodiment is also useful on a filler gun which has its gun head covered by a protective boot, because there is no need to remove the protective boot before fitting the carrying body to the filler gun.

It is also possible to provide a carrying body comprising a lower member, and an upper member releasably engaging with the lower member, the upper member having a top surface with a curved configuration along its length.

Although, in a preferred embodiment of the present invention, the two side panels are brought towards each other to lie against opposite sides of the gun head, it is possible, with a choice of suitable material for the lower member, to have the two side panels integrally joined at a front region thereof. Such a variant may be useful in order to provide typical male/female elements for matching and joining front region edges of the two side panels.

Contrary to the prior art carrying body, the carrying body of the present invention is made of a substantially hard plastic material, e.g. polyamide. The pivotally connected member or top member is also suitably made of a substantially hard plastic material, e.g. polycarbonate.

If the carrying body is provided with a pivotally connected top member, such member can be a lid with a transparent face portion for viewing a message therethrough, or a frame with an open space between opposite sides of the frame. In the case of a frame, the frame can be made of a transparent or non-transparent material, for example, polycarbonate, and the color thereof can therefore be of the same color as that of the carrying body or a color forming a typical contrast to the color of the carrying body. Also, such frame can have a portion carrying information related to the type of fuel supplied from the gun.

In yet another embodiment, a protective body is shaped to generally conform to enclose the gun head, the protective body having an upper surface. A first frame member engages the protective body and defines a first frame portion about a portion of the upper surface. A second frame member opposite the first frame member engages the protective body and defines a second frame portion configured to cooperate with the first frame portion to form a frame for releasably holding a message card between the frame and the upper surface. The protective body preferably includes a first and second member releasably engageable with one another. Preferably, a locking tab attaches to the first frame member for engaging the first frame member into a recess in the second frame member thereby forming a frame to hold the message card between the frame and the upper surface of the protective body. Further, each of the first and second frame members preferably engage the protective body at a hinged connection.

These, and further, embodiments of the display apparatus according to the present invention will appear from the description below with reference to the attached drawing figures, as well as the attached patent claims.

The present invention is now to be described with reference to the attached drawing figures illustrating preferred, but non-limitative embodiments of the present invention.

BRIEF DESCRIPTION OF THE DRAWINGS

FIGS. 25, 26 and 27 are side view, top view and perspective view, respectively, of a further modified upper member of the carrying body;

FIG. 28 is a cross-section XXVII—XXVII of FIG. 27;

FIG. 29 is an enlarged view XXIX of FIG. 28;

DETAILED DESCRIPTION OF THE PREFERRED EMBODIMENT(S)

Figure 1:
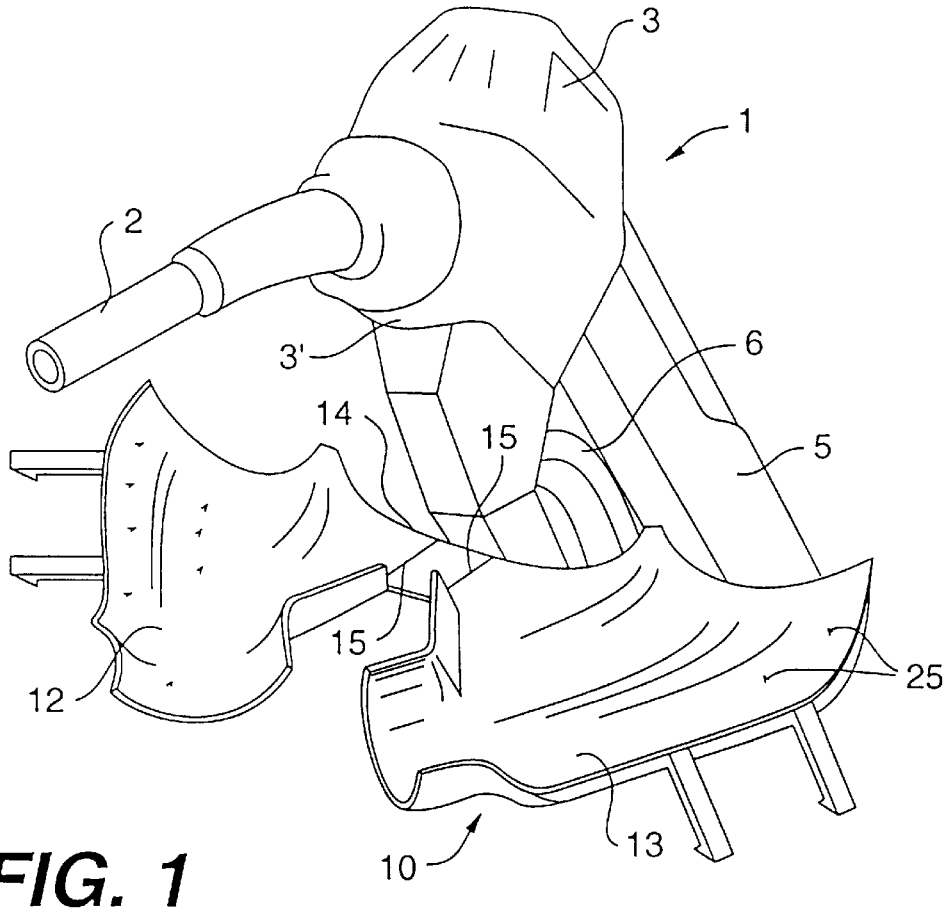
FIGS. 1 and 2 illustrate fitting of a lower member of the carrying body of the present invention onto a filler gun head.
Figure 2:
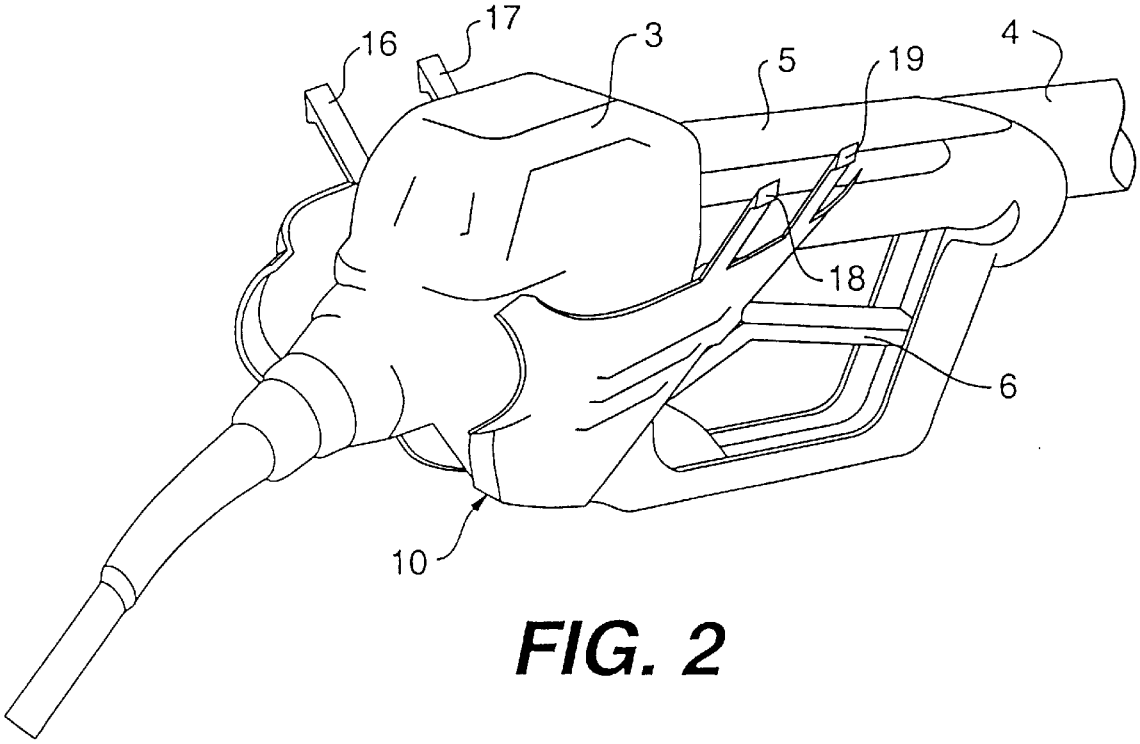

FIGS. 1 and 2 show a filler gun 1 of a fluid pump, e.g., a fuel pump, oil pump or the like. The filler gun includes a fluid gun nozzle 2 for discharging fuel at its front end and a gun head 3 having internally located fuel valve means (not shown). The valve outlet means communicates with the nozzle 2 and a valve inlet means (not shown) communicates with fluid supply means connected to a fluid hose 4, the fluid supply means extending through a handle 5 of the gun. The handle 5 has lever means 6 which are operatively connected to the valve means. The gun head 3 may be of an unprotected type, or may be covered by a protective boot of rubber or plastic material as indicated by reference number 3'.

Figure 4:
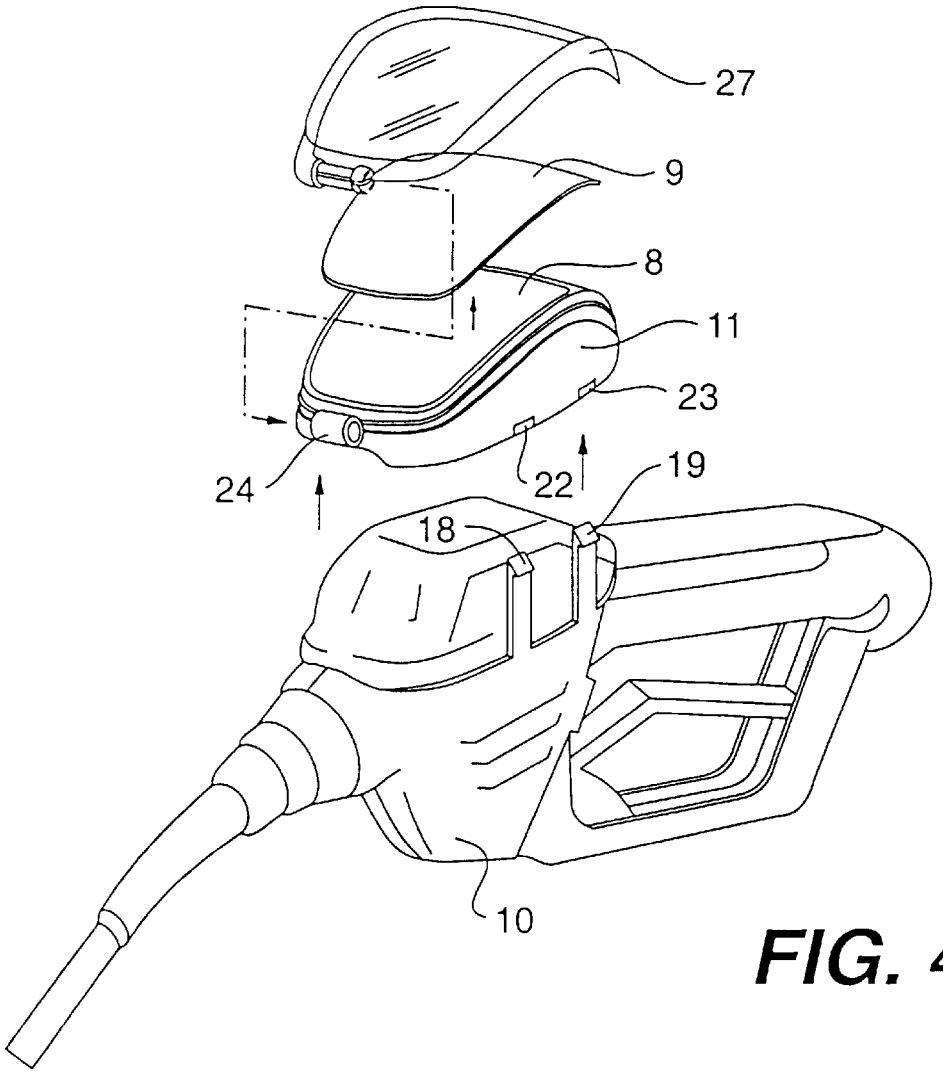
FIG. 4 further illustrates mounting of the upper member onto the filler gun and with pivotable engagement of a top member with the upper member.
Figure 5:
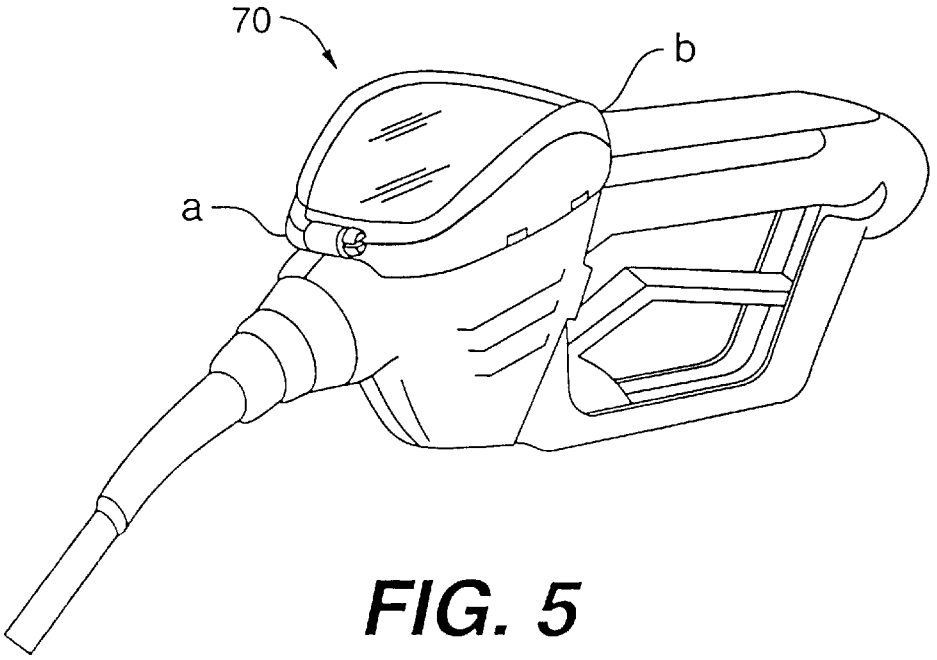
FIG. 5 shows a carrying body with the top member fully installed on the filler gun.

As shown in FIGS. 4 and 5, the filler gun is provided with a display apparatus, generally denoted by reference number 70. Such display apparatus is intended for supporting on its upper surface 8 a message card 9 for displaying a graphic message readily viewable by a filler gun user.

As clearly shown in FIGS. 4 and 5, the carrying body 7 for the graphic message is adapted to fit over the filler gun to extend from approximately the junction "a" of the gun nozzle 2 with the gun head 3 to approximately the junction "b" of the gun head 3 with a forward end of the handle 5. The display surface 8 for the graphic message, when the carrying body 7 is attached to the filler gun, extends longitudinally along the filler gun from approximately the junction "a" of the gun head 3 with the nozzle 2 to approximately the junction "b" of the gun head with a forward end of the handle of the gun.

As clearly seen from FIGS. 1–5, the carrying body 7 comprises a lower member 10 and an upper member 11 releasably engageable with the lower member 10. The lower member 10 has two side panels 12, 13, a bottom element 14, and means 15, such as film hinges or other transition means, integrally connecting side panels 12, 13 with the bottom element 14. As shown in FIG. 2, the lower member 10 with its side panels 12, 13 and bottom element 14 are brought to lie against the gun head 3, substantially fitting around a lower part of the gun head. At the top region of the side panels there are first interlocking means 16, 17 and 18, 19 on the respective panels 12 and 13. The first interlocking means 16–19 are suitably formed as male elements in the form of snap hooks.

Figure 3:
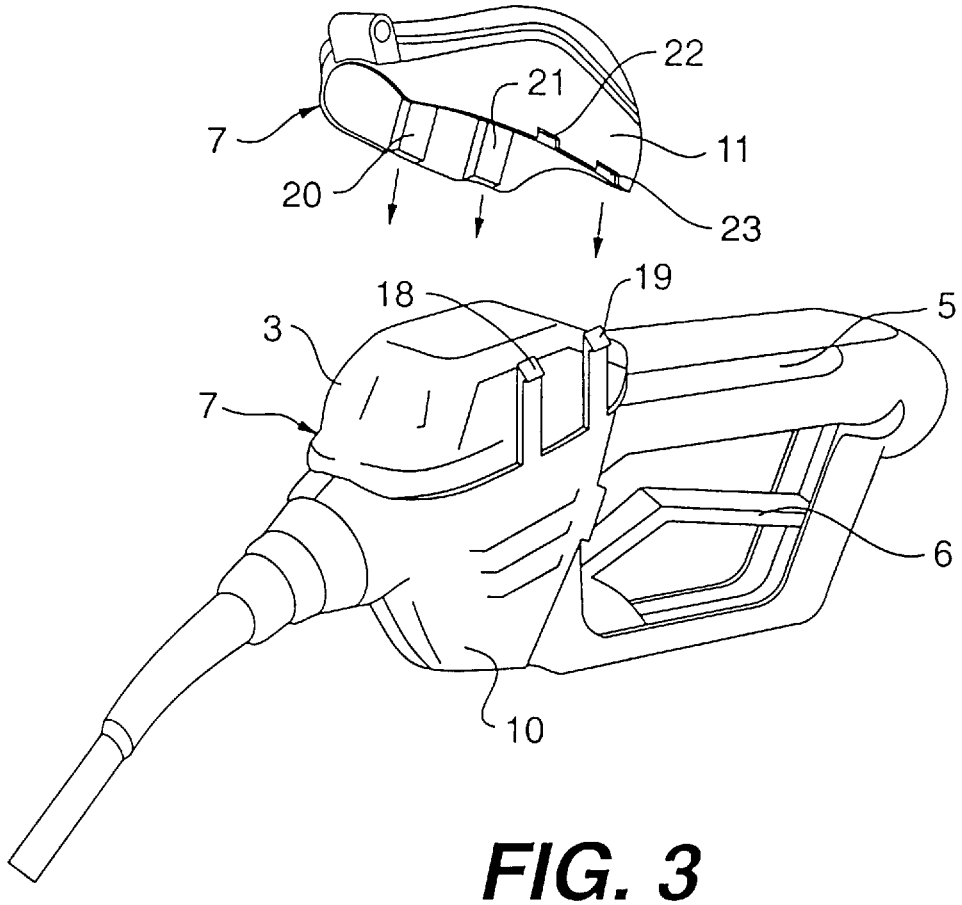
FIG. 3 illustrates fitting of an upper member of the carrying body onto the filler gun head through engagement with the lower member.
Figure 10:
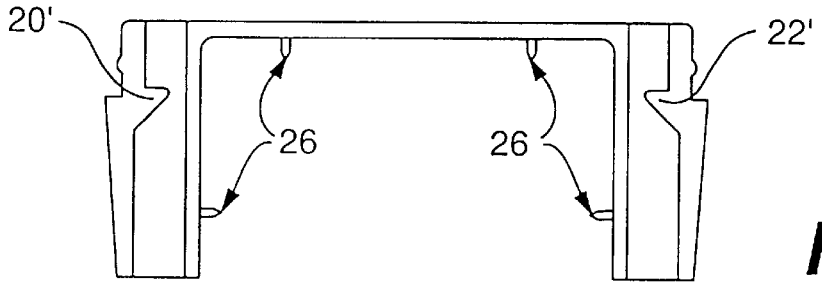
Figure 11:
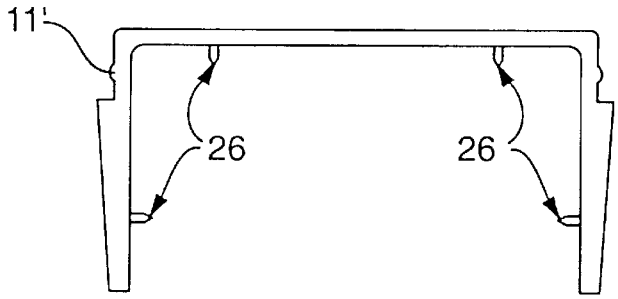

As seen from FIGS. 3 and 4, the upper member 11 is formed as cap-like means to fit over an upper part of the gun head 3. The upper member 11 has second interlocking means 20, 21 and 22, 23 for releasably engaging the first interlocking means 16, 17 and 18, 19, respectively, on the lower member. The second interlocking means are formed as female elements having means, e.g. in the form of a ledge or set-off 20', 21', 22', 23' as indicated more closely in FIGS. 7, 8, and 10. FIG. 1 shows that the panels 12, 13, bottom element 14, connecting means 15, and the first interlocking means 16–19 are formed as an integrally made structure, e.g. through an injection molding process.

Figure 14:
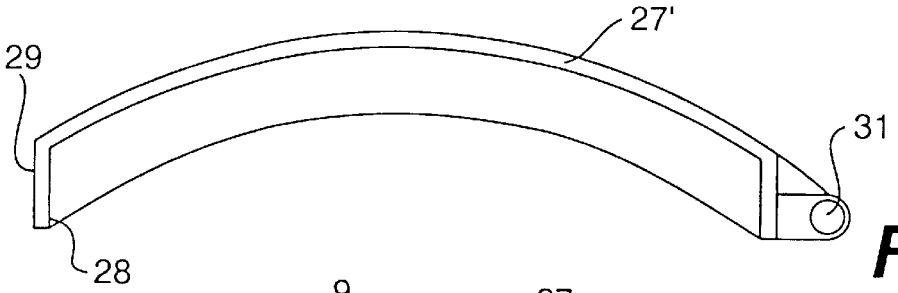
FIG. 14 is cross-section XIV—XIV of FIG. 13.
Figure 15:
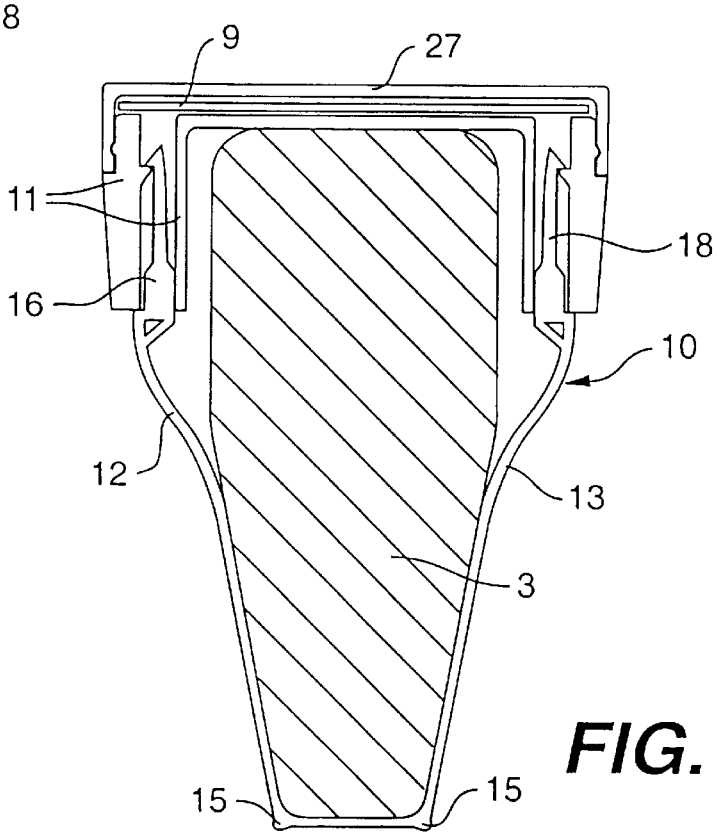
FIG. 15 is a cross-section through the display apparatus with the top member of FIG. 13 and installed on a filler gun.

As seen from FIG. 6, the upper member 11 has an upper peripheral portion 11' with a bead 11" extending along the upper peripheral portion 11' for releasably engaging a peripheral skirt portion of a top member located on the upper member 11, as will be explained further with reference to FIGS. 13–15.

At a forward end of the upper member, there is provided a first hinge means 24 in the form of a protruding member having a transverse hole 24'.

As illustrated in FIGS. 1 and 2, side panels 12, 13 may be provided with a plurality of integrally made studs 25 which both compensate for any tolerances in the space between the panels 12, 13 and the gun head 3 as well as being able to penetrate partly into any protective boot provided on the gun head. Thus, when fitted around the gun head 3, the lower member 10 may obtain an improved contact with the gun head 3.

Similarly, as indicated in FIGS. 8–11, the upper member 11 may have similar or technically equivalent space compensating studs, generally denoted by reference number 26. The studs should be so dimensioned that they will easily yield and/or penetrate into the soft protective boot covering the gun head if so provided.

Figure 12:
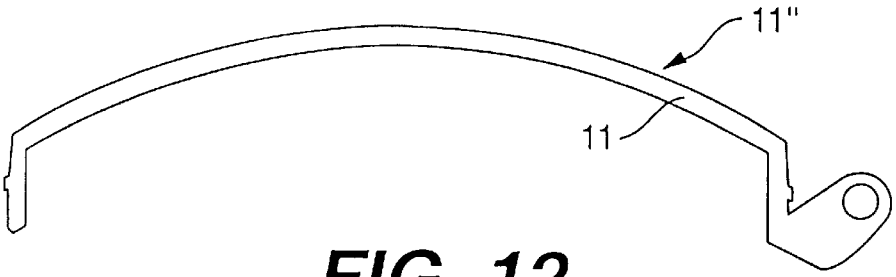

FIG. 12 discloses that the top face 11 '" of the upper member 11 has a curved configuration along its length. In a first embodiment, the top member shown in FIG. 4 and also in FIG. 13, is labeled with reference number 27 and is formed as a lid with a transparent face portion 27' for viewing a message on the message card 9. The top member 27 has means in the form of thickened portions 28 on a peripheral skirt portion 29 depending from the transparent face portion 21' designed to engage the bead 11' on the upper member 11. Space is provided between an upper surface of the upper member 11 and a portion of the top member 27 in order that the replaceable message card 9 can be located in such space when the top member 27 and the upper member 11 engage, as illustrated in FIG. 15. FIG. 15 shows how the lower member 10, with its side panels 12, 13 and the first interlocking means 16, 18, is capable of snap locking to the upper member 11.

The top member 27 is suitably provided with a second hinge means 30 engageable with the first hinge means 24 on the upper member 11 for pivotable attachment of the top member 27 to the upper member 11. The second hinge means has a protrusion integral with a pin 31, having a slit 32 and a thickened end 33.

Figure 16:
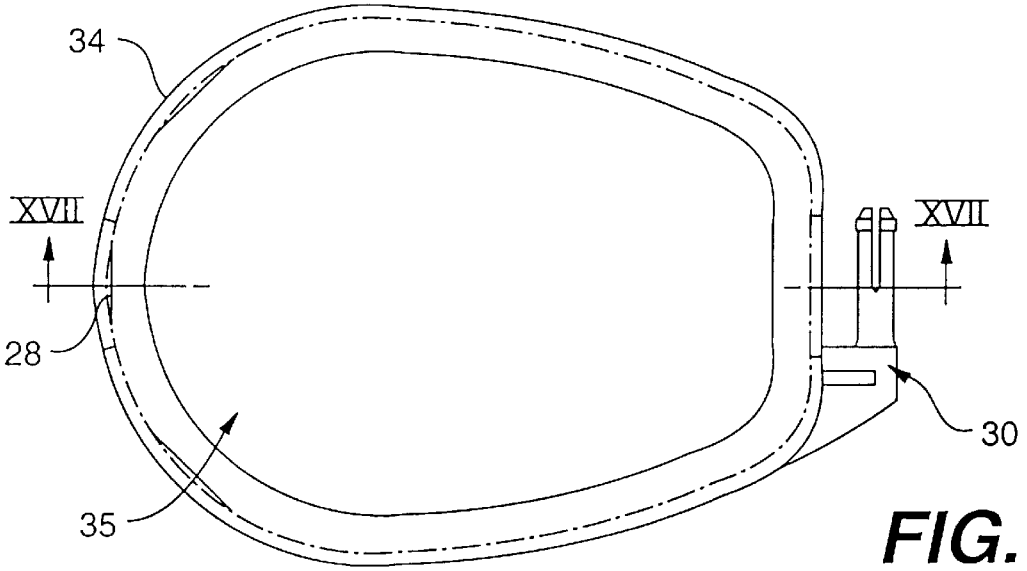
FIG. 16 is a top plan view of a modified top member of the display apparatus formed as an open frame.
Figure 17:
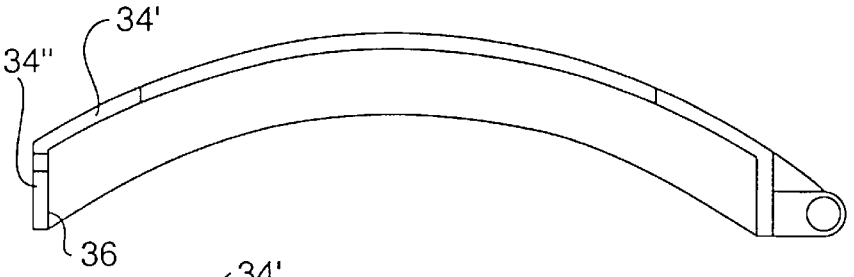
FIG. 17 is cross-section XVII—XVII of FIG. 16.
Figure 18:
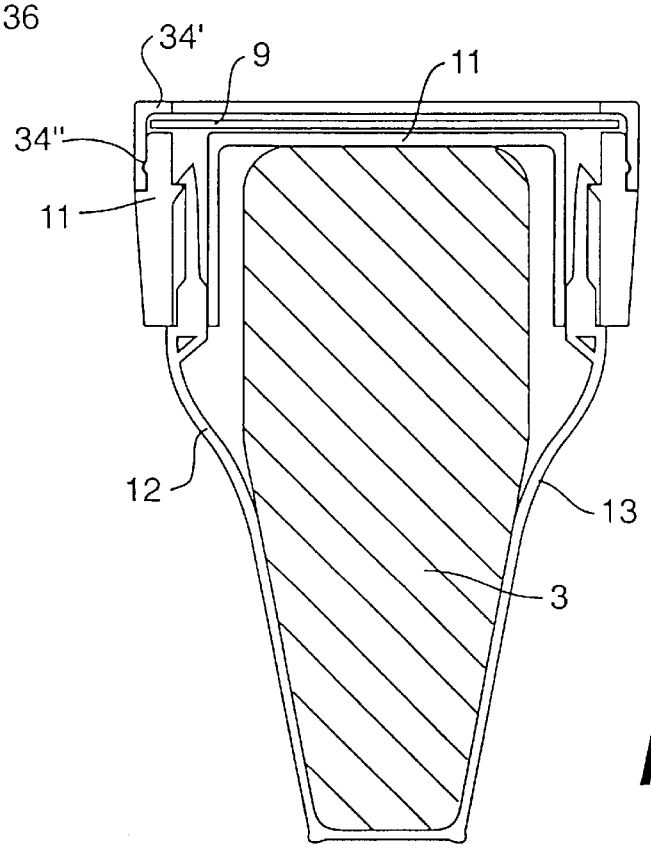
FIG. 18 is a cross-section of the display apparatus, according to the present invention fitted onto a filler gun and with a top member according to FIG. 16.

FIGS. 16–20 will now be explained with regard to the differences from what is shown and described in connection with FIGS. 13–15. Instead of the top member 27 being formed as a lid, the embodiment of FIG. 16 shows a top member 34 formed as a frame with open space 35 between opposite sides of the frame. The frame has a first element 34' for laying over a marginal edge portion of a top surface of the upper member 11, as clearly illustrated in FIG. 18, and a second element 34" integral with the first element 34' for releasably engaging upper, peripheral portion of the upper member 11. As similarly shown in FIG. 13, the second element may be provided with second portions 36 for releasable engagement with upper peripheral portion of the upper member. Similarly to that shown in FIGS. 13 and 14, the top member according to FIG. 16 is provided with a second hinge means 30.

The top member of FIG. 16 can be made of a transparent material. Alternatively, it can be made of a non-transparent material, e.g. of a color that is the same as that of the upper member 11 or a color forming a suitable contrast with the color of member 11.

Figure 19:
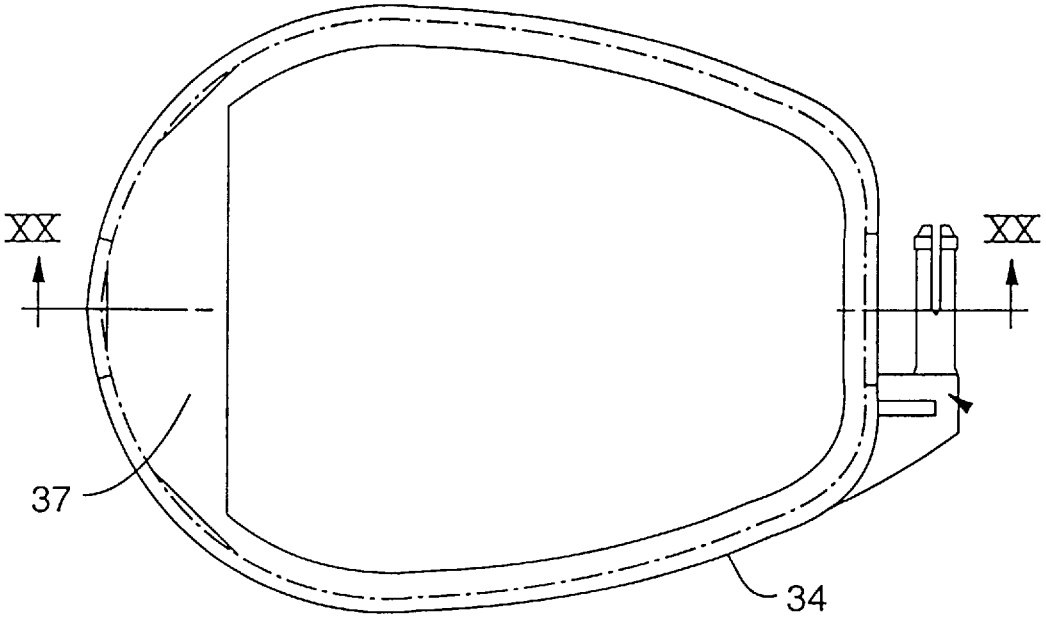
FIG. 19 shows a top plan view of a modification of the top member of FIG. 16.

FIG. 19 is a slight modification of the embodiment of FIG. 16, in that a rear end of the top member has a widened position, as seen in the longitudinal direction of the top member. The widened portion of the frame is labeled with reference number 37 and is in reality a widened portion of the first element 34' as shown and described in connection with FIG. 16 and 17. The widened portion 37 of the frame is suitable for carrying information related to type of fuel supplied from the gun, e.g. "PREMIUM."

Figure 20:
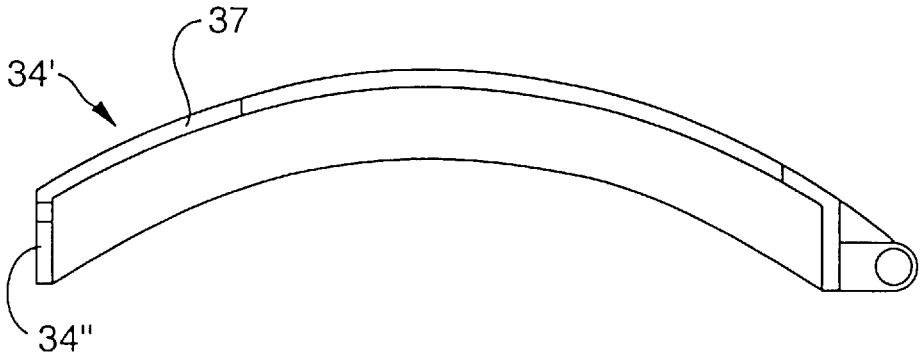
FIG. 20 is a cross-section XX—XX of FIG. 19.
Figure 21:
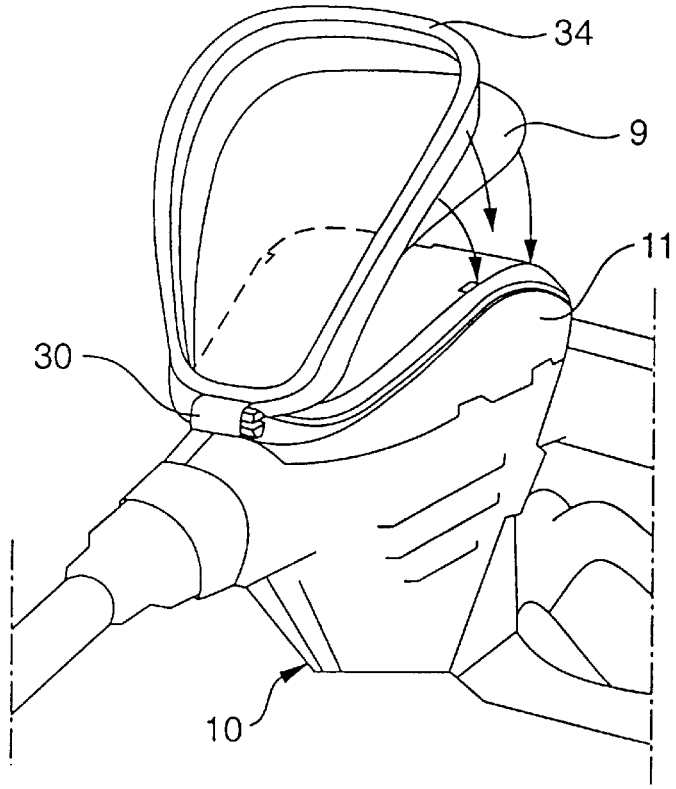
FIG. 21 illustrates in a perspective view the display apparatus installed on a filler gun with a top member according to FIG. 16.
Figure 22:
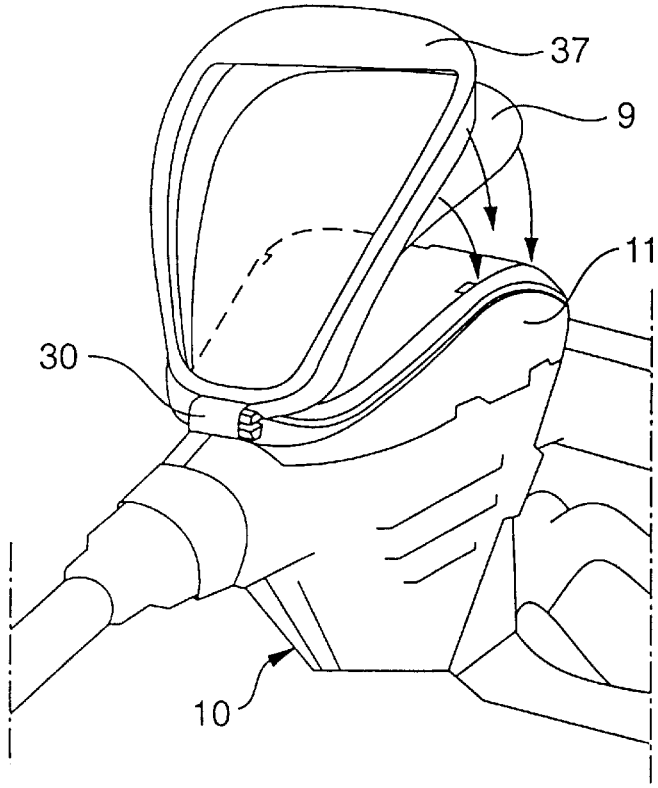
FIG. 22 shows in perspective view a display apparatus according to the present invention installed on a filler gun and with a top member according to FIG. 19.

FIG. 21 is a perspective view of the embodiment according to FIGS. 16–18, and FIG. 22 is a perspective view of the embodiment according to FIGS. 19 and 20.

Figure 6:
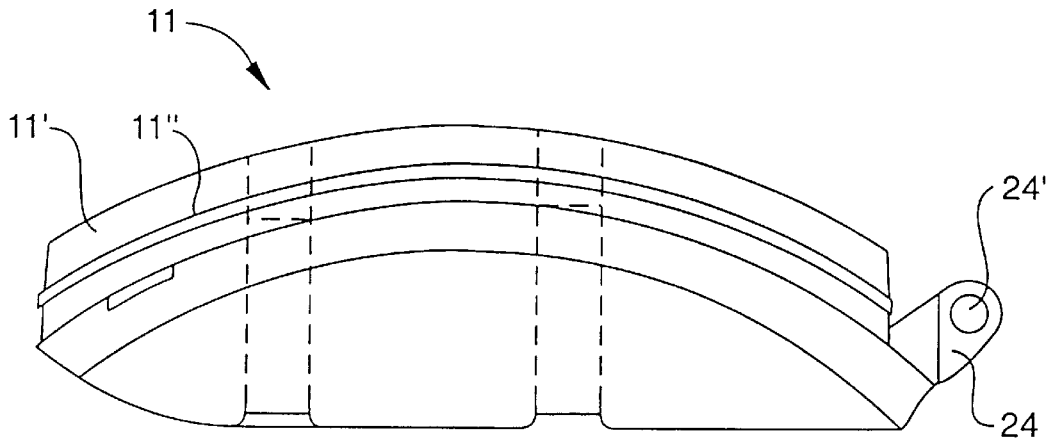
FIG. 6 is a side view of the upper member of the carrying body, according to the present invention.
Figure 7:
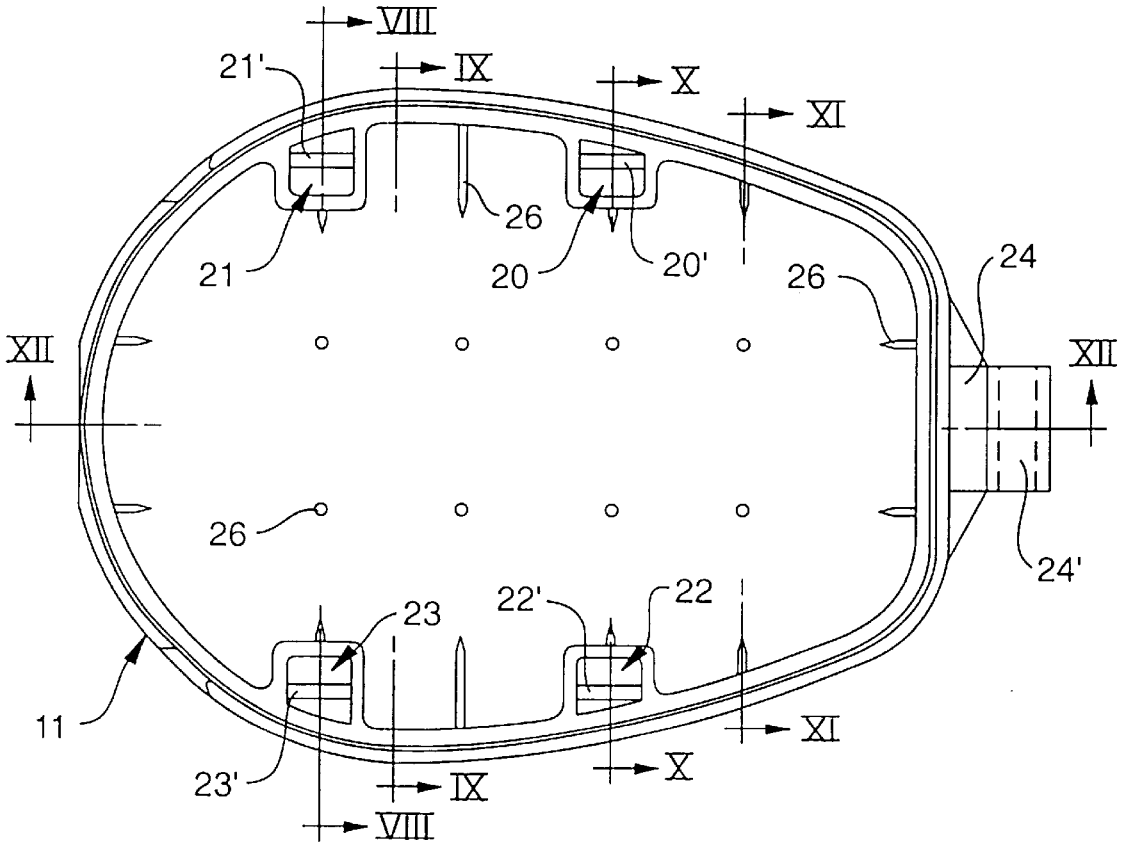
FIG. 7 is a bottom view of the upper member of the carrying body, according to the present invention.
Figure 8:
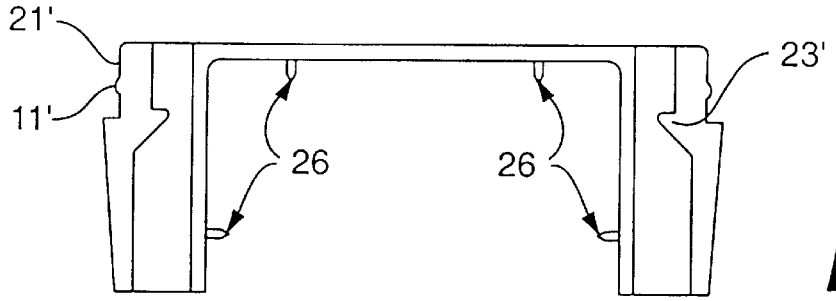
FIGS. 8, 9, 10, 11 and 12 are cross-sectional views VIII, IX, X, XI and XII of FIG. 7.
Figure 9:
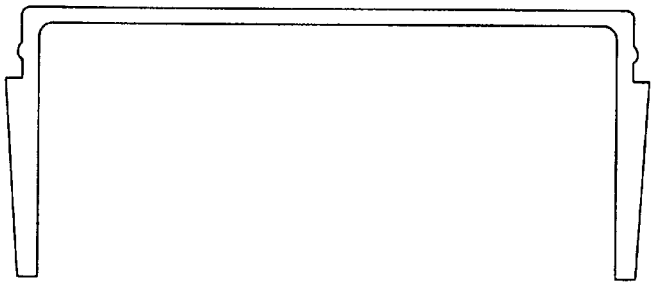
Figure 13:
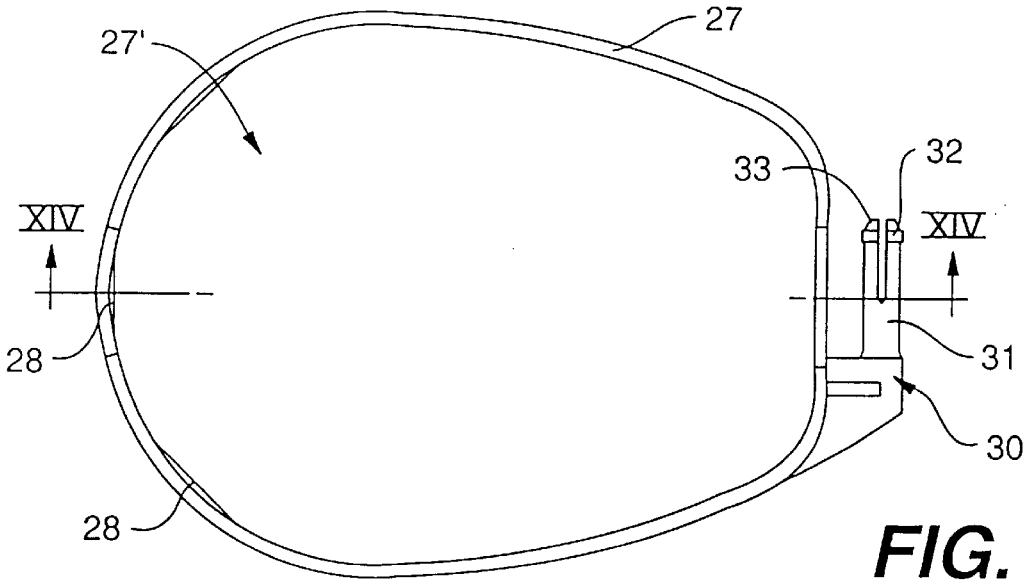
FIG. 13 is a top plan view of a top member of the display apparatus, according to the invention.
Figure 34:
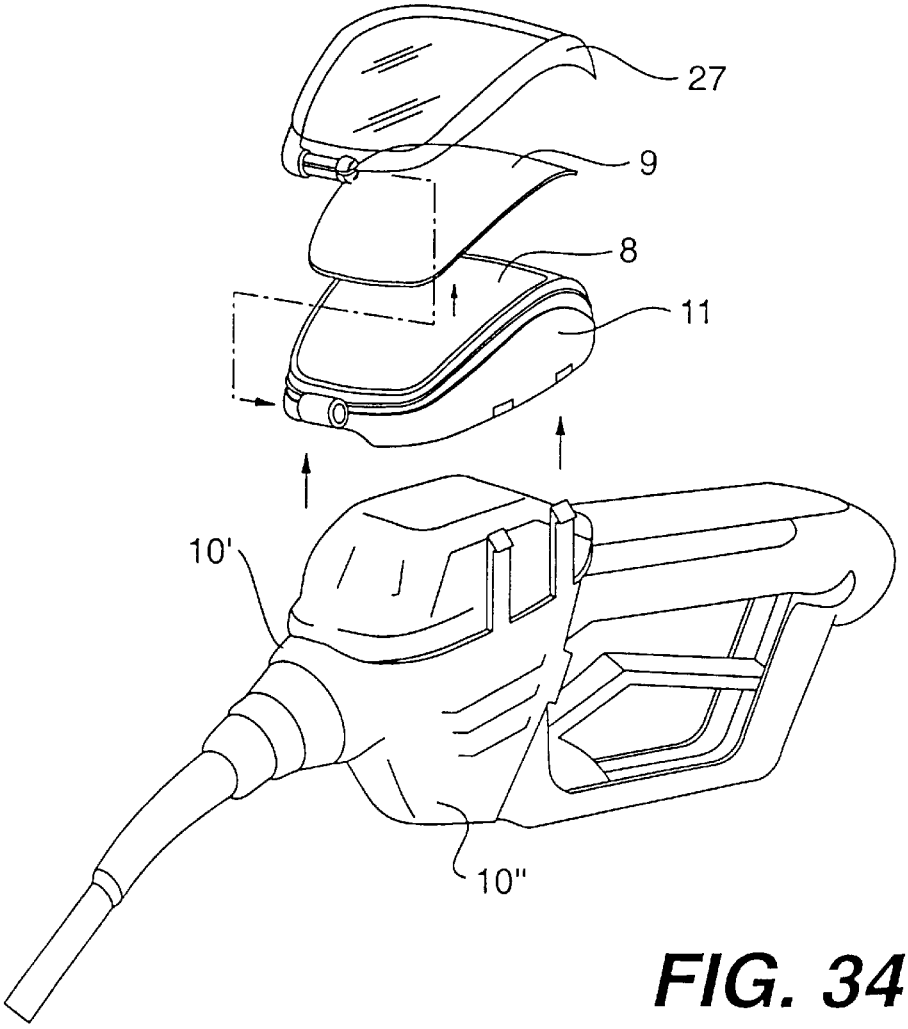

FIG. 13, with reference to FIGS. 6 and 7, shows the second hinge means being in the form of the male member 31 which is capable of releasable snap engagement with the female member 24 of the hinge connection between the upper member 11 and its top member, e.g. 27 as shown in FIG. 13 or 34 as shown in FIG. 16, or the modified version of the top member 34 shown in FIG. 19.

Figure 37:
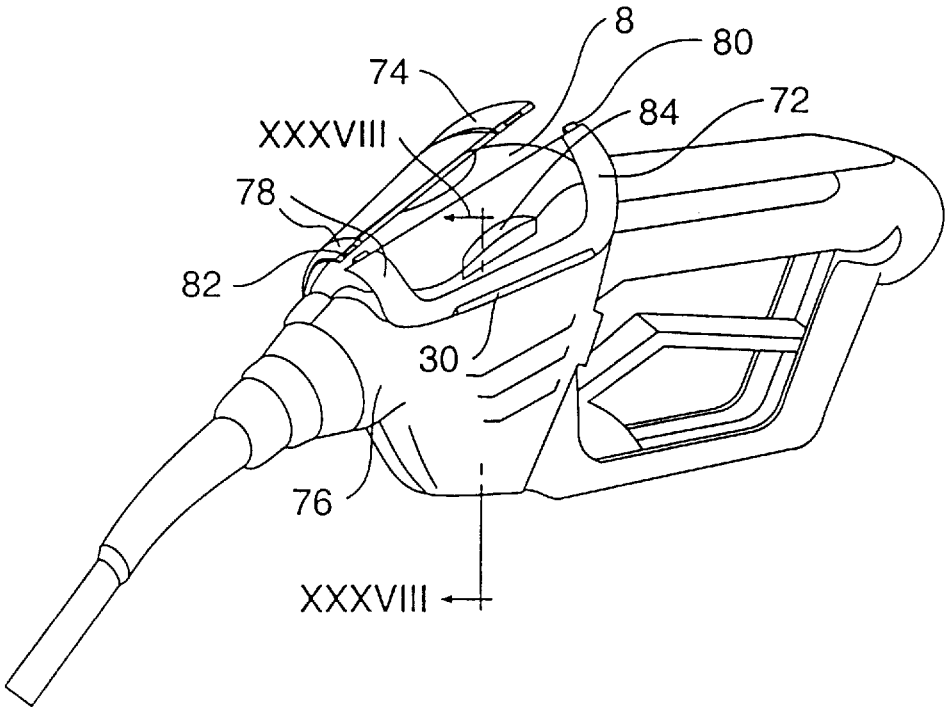
FIG. 37 is a perspective view of an embodiment of the invention having two pivotal frame members.
Figure 38:
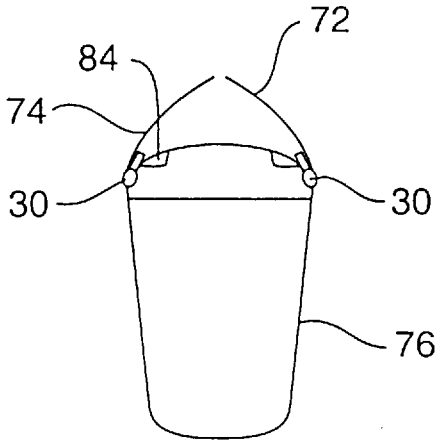
FIG. 38 is a cross-section XXXVIII—XXXVIII of FIG. 37.

Another embodiment of the present invention is shown in FIGS. 37 and 38. As shown in FIGS. 37 and 38, first and second frame members, 72 and 74, pivotally attach to a protective body 76 shaped to generally conform to enclose side, bottom, and upper portions of the gun head 3. The protective body 76 has an upper surface 8 and preferably includes a first member 10 and second member 11 releasably engageable with one another. The first and second members 10, 11 are preferably configured as described above for lower member 10 and upper member 11, respectively.

The first and second frame members 72 and 74 pivotally attach to protective body 76 at hinge member 30 to be pivotable with respect to protective body 76. As described above, a male member 31 provided on each of frame members 72 and 74 inserts into hinge member 30 to define the pivotable hinge. The male members 31 may be withdrawn from hinge member 30, allowing the frames 72 or 74 to be removed. Alternatively, first and second frame members 72 and 74 may be integrally formed with protective body 76.

In this embodiment, first frame member 72 engages with protective body 76 and defines a first frame portion about a portion of the upper surface 8 of the protective body 76. Second frame member 74 opposite first frame member 72 engages protective body 76 and defines a second frame portion configured to cooperate with the first frame portion to form a frame 78 for releasably holding message card 9 between frame 78 and upper surface 8.

In order to hold first and second frames 72 and 74 together and against the upper surface 8 of the protective body 76, a generally L-shaped locking tab 80 is provided, projecting from first frame member 72 for engagement with a recess 82 in second frame member 74, to form frame 78. Locking tab 80 preferably is made of plastic and has sufficient flexibility to be bent backward by manual force in order to disengage from second frame member 74, yet sufficient rigidity to snap forward upon release.

Upper surface 8 of protective body 76 toward the side of gun head 3 preferably includes an indented portion 84 to ease the grasping of message card 9 for removal from display apparatus 70. Indented portion 84 enables the fingers of an individual changing message card 9 to more easily grasp message card 9 by its upper and lower surfaces.

Figure 39:
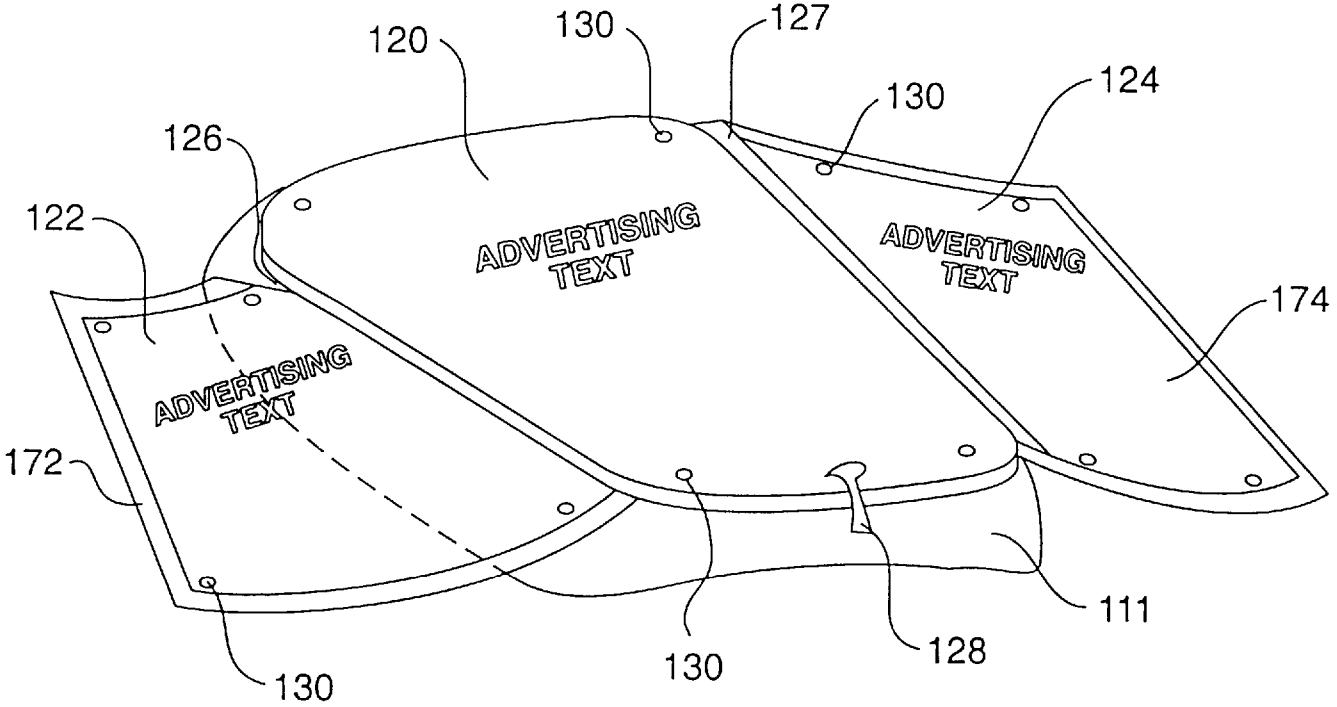
FIG. 39 is a perspective view of the embodiment of FIG. 37 with the two pivotal frame members fully open.

An alternative embodiment of that shown in FIGS. 37 and 38 is shown in FIG. 39. In this embodiment, an upper member 111 includes first and second frame members 172 and 174, exactly as described above for FIGS. 37 and 38. However, in this embodiment, respective first and second spring-loaded hinge members 126 and 127 connect each frame member 172 and 174 to upper member 111. Upon pressing a quick-release latch mechanism 128, first and second frame members 172 and 174 spring fully open, as shown in FIG. 39. Latch mechanism 128 also can be configured to operate automatically upon operation of the filler gun. The first and second frame members 172 and 174 can be closed against the bias of spring-loaded hinges 126 and 127.

The purpose of the embodiment of FIG. 39 is to protect the advertising text on the display card and to further maximize the available display surface. It is contemplated that a first display card 120 can be positioned on the upper surface of upper member 111, and that additional second and third replaceable display cards 122 and 124 can be inserted within the first and second frame members 172 and 174. The display cards 120, 122 and 124 are all attachable to the respective portions of the device by insertion of projecting tabs 130 through corresponding apertures in the display cards, or by other well-known attachment devices. As shown in FIG. 39, the advertising text on the surfaces of the three display cards 120, 122, and 124 is visible when the first and second frame members 172 and 174 are open. Therefore, it is also preferable to provide a generic message, e.g., "Turn Off Engine When Filling Tank," on the external surface of display cards 122 and 124, which will be visible to the customer when the first and second frame members 172 and 174 are closed. When the customer activates the filler gun, first and second frame members 172 and 174 can be freed to spring open, displaying the advertising text on display card 120 and the internal sides of display cards 122 and 124. The external sides of display cards 122 and 124 thereby can function to protect the actual advertising text from the elements.

Figure 23:
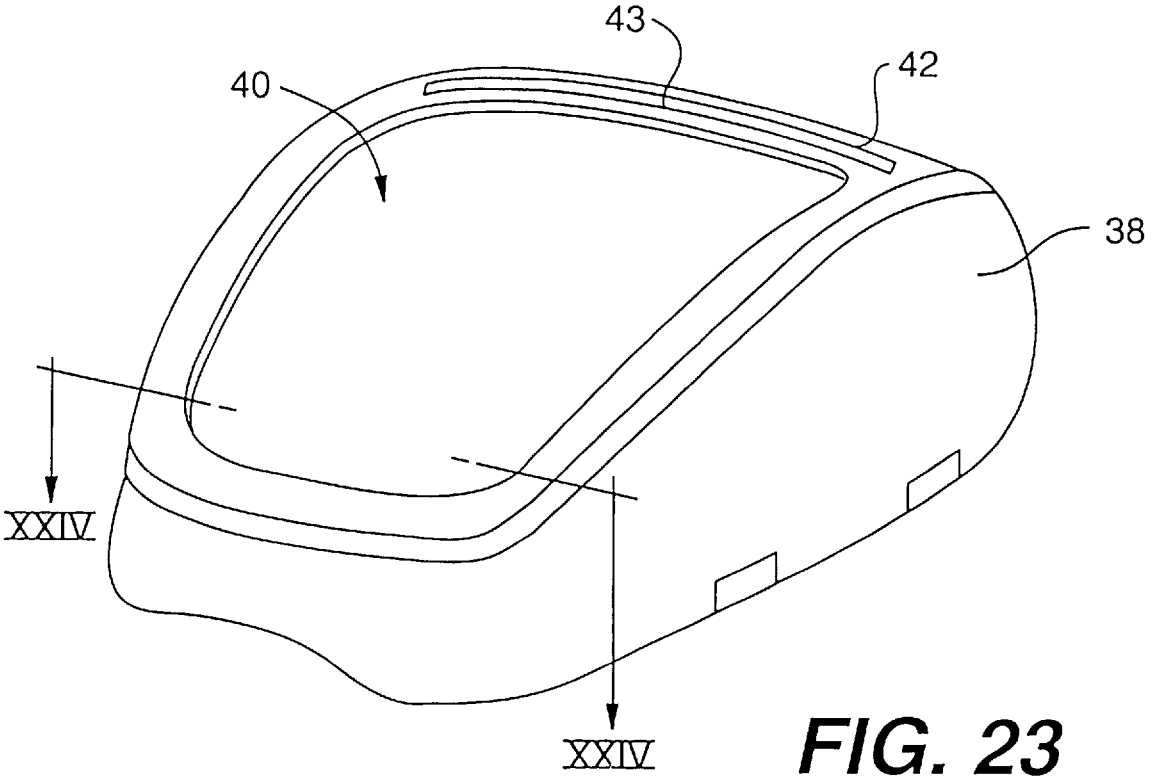
FIG. 23 shows a further embodiment of an upper member of the carrying body of the display apparatus according to the present invention, with an integral frame structure at the top surface of the upper member.
Figure 24:
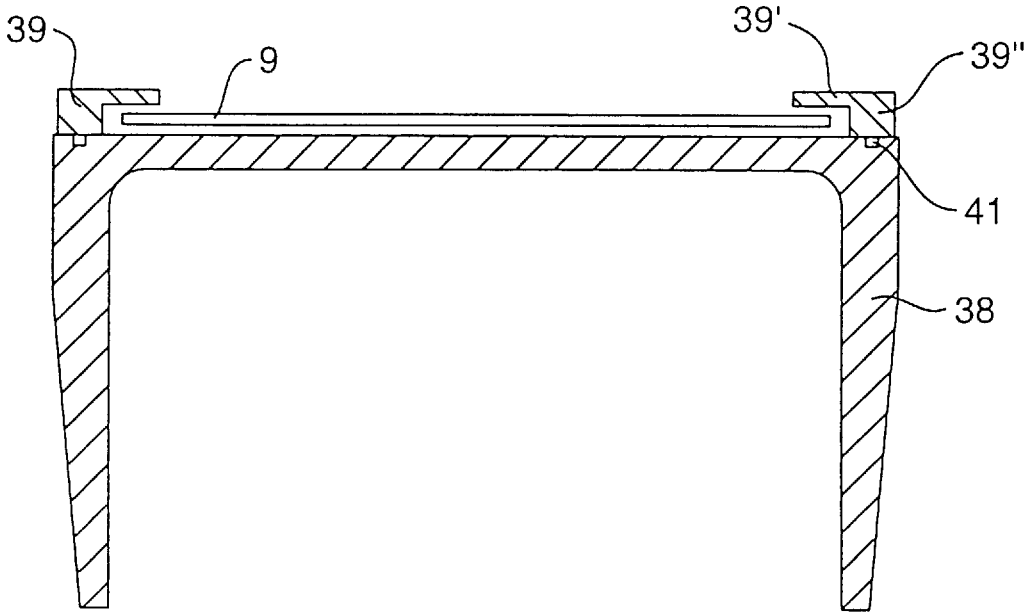
FIG. 24 is a cross-section XXIV—XXIV of FIG. 23.
Figure 25:
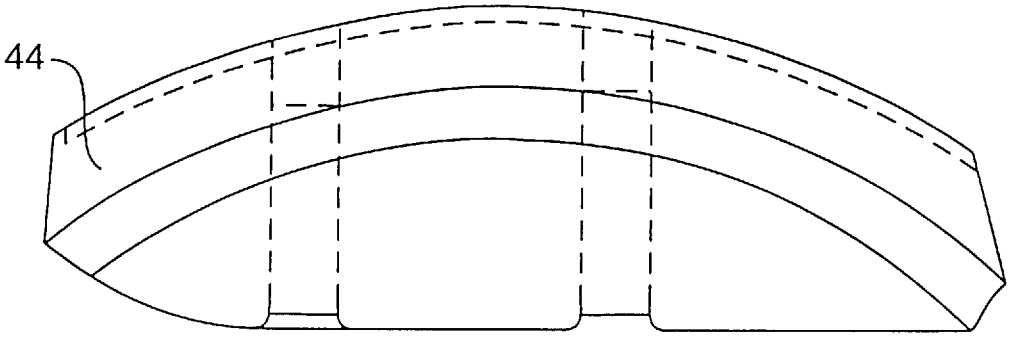

A modified version of the upper member 11 is shown in FIGS. 23 and 24, the modified upper member being denoted by reference number 38. The upper member 38 has along its peripheral outline a frame member 39 formed with open space 40 between opposite sides of the frame 39. The frame has a first element 39' located over a marginal top edge portion of the upper surface of the upper member 38, and a second element 39" integral with the first element 39'. The second element is preferably integral with the upper surface of the upper member, e.g. by welding or through the use of suitable adhesive. In order to properly locate the frame 39 onto the upper member 38, e.g. during welding or other operation for joining the two male/female members, denoted by reference numeral 41 may be provided on the frame 39 and the upper member 38, respectively.

To provide insertion of a message card 9 in the space between the upper surface of the upper member 38 and the first element 39' of frame 39, a slot 42 may be provided as shown e.g. by dotted lines on FIG. 23, the slot being provided suitably in the second element 39" of the frame 39. Alternatively, the first element 39' of the frame 39 may have a removed section 43 to facilitate insertion and removal of the message card 9.

An additional modification of the upper member 11 is shown and described with reference to FIGS. 25–29. In this embodiment, the upper member is labeled with reference numeral 44. It has a top surface 44' and, along at least a portion of the peripheral edge of the top surface, an upwardly extending rim 45. The rim is suitably only a few millimeters high, maybe even less. Means in the form of studs 46 protrude upwardly from the surface 44', the protruding means 46 having a substantially arrow-shaped shaped configuration, a straight upright portion thereof having a height substantially equal to the thickness "d" of the message card 9.

When the message card 9 is positioned inside the inner circumference of the rim 45, as indicated on FIG. 27, holes 47 provided in the message card 9 are brought into snap-like engagement with the arrow-shaped studs 46. Thus, the message card 9 is held suitably in place on the upper member 44. To provide for drainage of any rain water when the gun is located on the fuel pump between filling operations, the rim 45 is suitably provided with an opening 45' as indicated in FIG. 27. The opening 45' also provides for easier removal of the message card 9 when it is to be replaced by a new message card.

Figure 26:
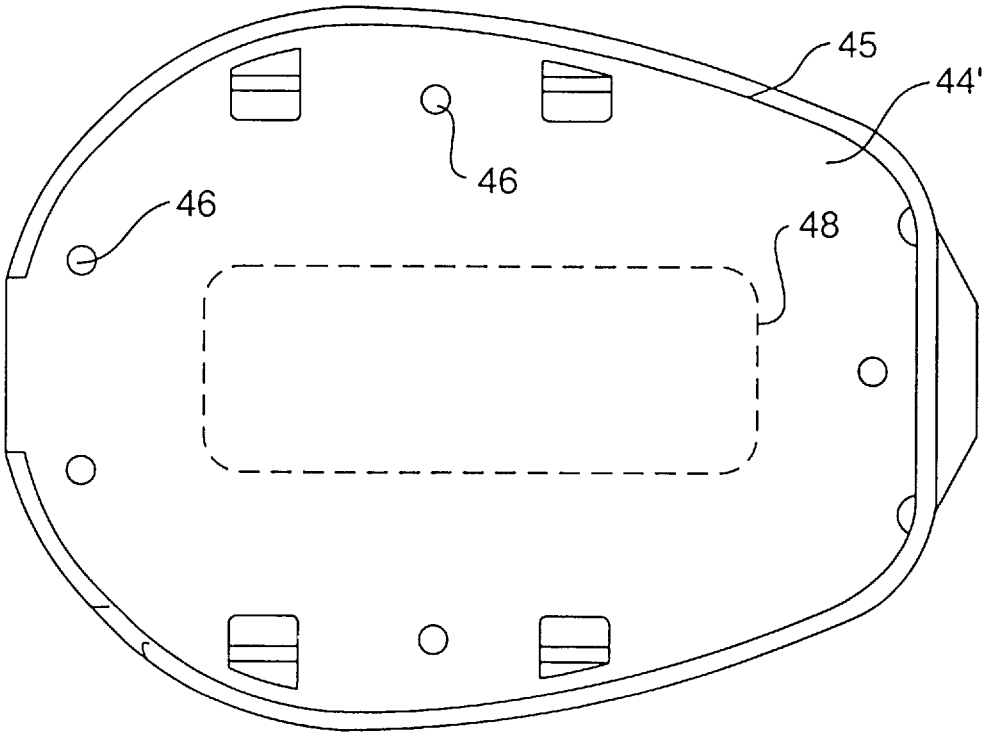

To further secure the message card 9 onto the top surface 44' of the upper member 44, a region of adhesive 48 may be applied to the upper surface 44' of the upper member 44, as indicated in FIG. 26. Alternatively, the adhesive may be available on the rear side of the message card 9 and be of a type which, for example, firmly adheres to the rear side of the message card 9, but not so firmly that it sticks to the upper surface 44' of the upper member 44.

Figure 30:
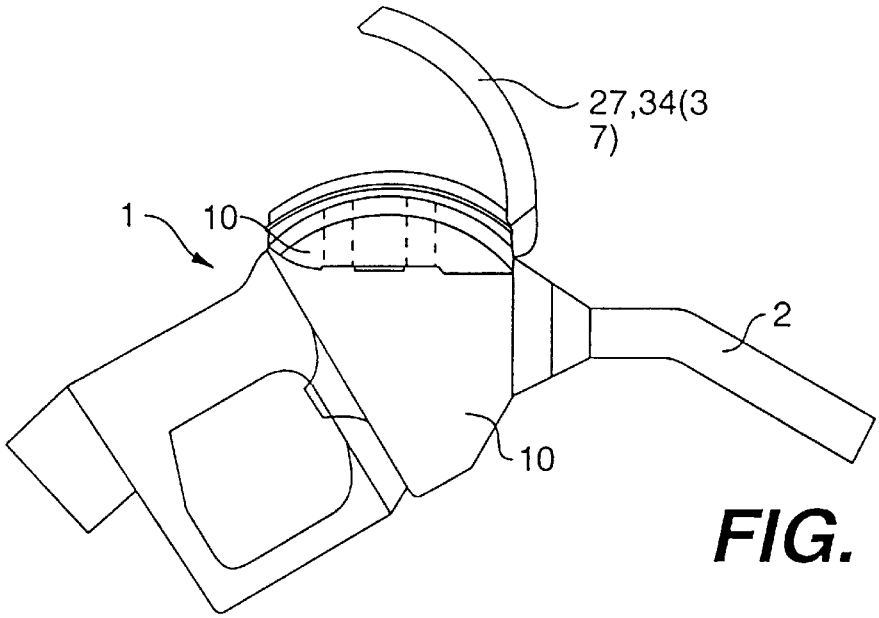
FIG. 30 is a side view of a filler gun with a two-part carrying body fitted thereon and with a pivotally connected top member fitted onto the carrying body.

FIG. 30 illustrates how the display apparatus according to the present invention and in accordance with the embodiments shown and described in connection with FIGS. 1–22 appears in a side view when mounted on a filler gun.

Figure 31:
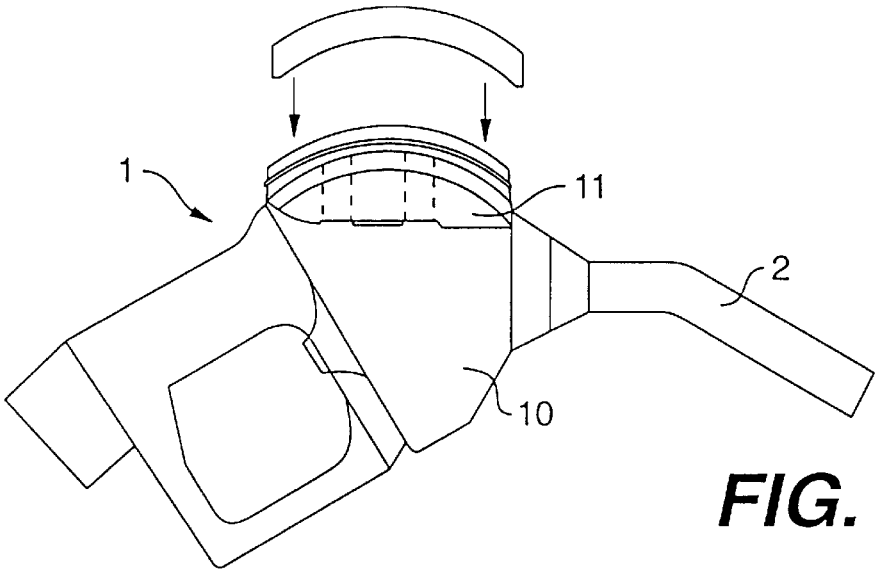
FIG. 31 is a side view of a filler gun with a two-part carrying body fitted thereon, and with a top member engageable with an upper part of the carrying body.

FIG. 31 illustrates that the top member 27; 34 (and 37) could be replaced by a top member 49 having no pivotable connection with the upper member 11. In such a variant, the hinge means 24, 30 are not present.

Figure 32:
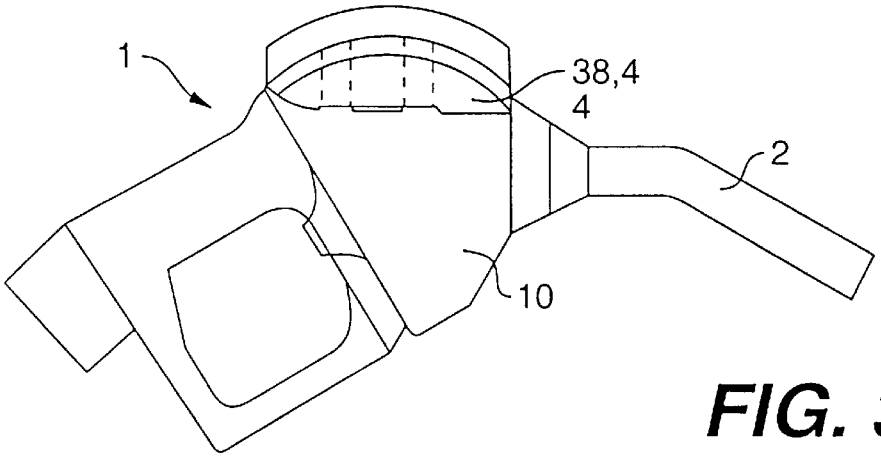
FIG. 32 is a side view of a filler gun with a two-part carrying body fitted thereon, and in accordance with the embodiments shown in FIGS. 23, 24, and 25–29.

FIG. 32 illustrates a side view of the embodiments according to FIGS. 23, 24 and 25–29.

In connection with the description of FIGS. 1 and 2, it should be noted that the side panels 12, 13 at the front region have edges which mate when the panels are brought to lie against the gun head. Until such moment, the edges are spaced apart.

Figure 33:
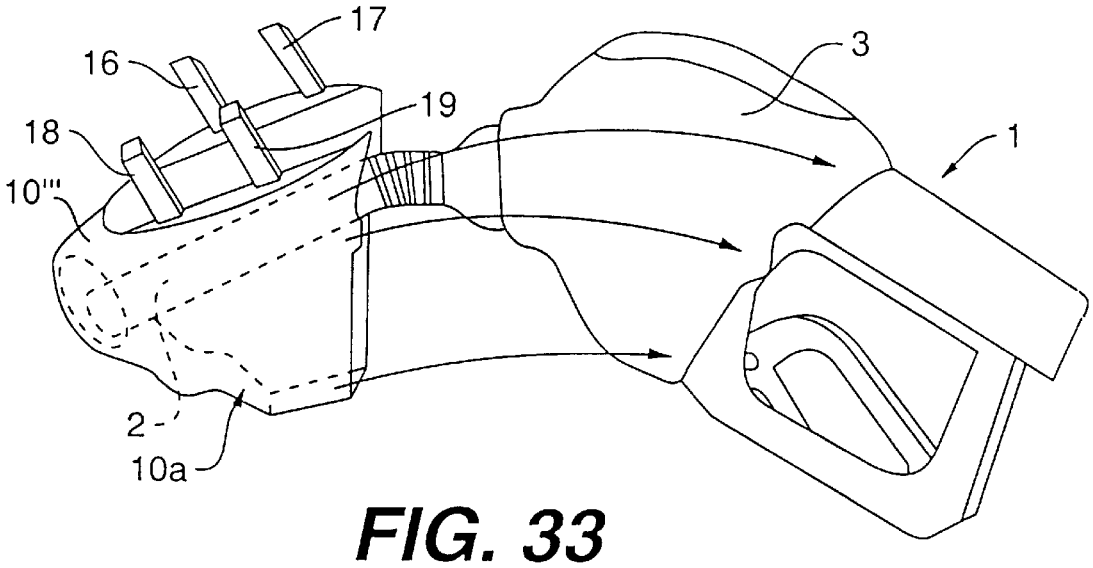
FIGS. 33–35 illustrate fitting of the lower member of the carrying body onto the filler gun when the lower member at its front end region has its side panels integrally joined.
Figure 35:
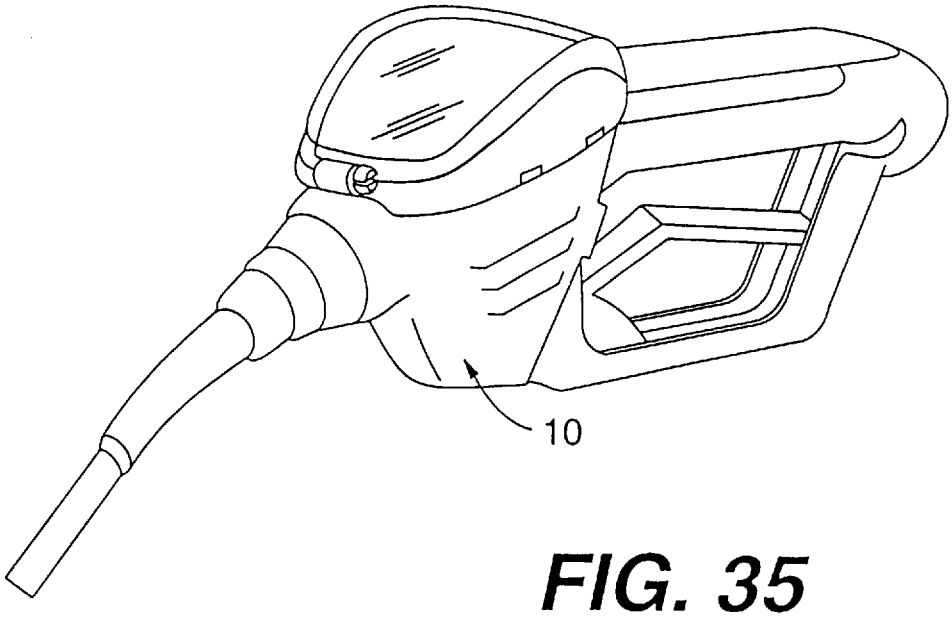

However, in a modified embodiment of the lower member 10, denoted by reference numeral 10*a* in FIGS. 33 and 35, it is proposed, to let the two side panels 12, 13 be integrally joined at a front region thereof. Suitably, the front region of the two side panels is above, as indicated by reference number 10' and below as indicated by reference number 10" a front opening 10'" in the lower member, through which the fuel gun nozzle 2 extends when the lower member 10*a* is brought into engagement with the gun head 3 on the filler gun 1, as illustrated on FIG. 33.

Figure 36:
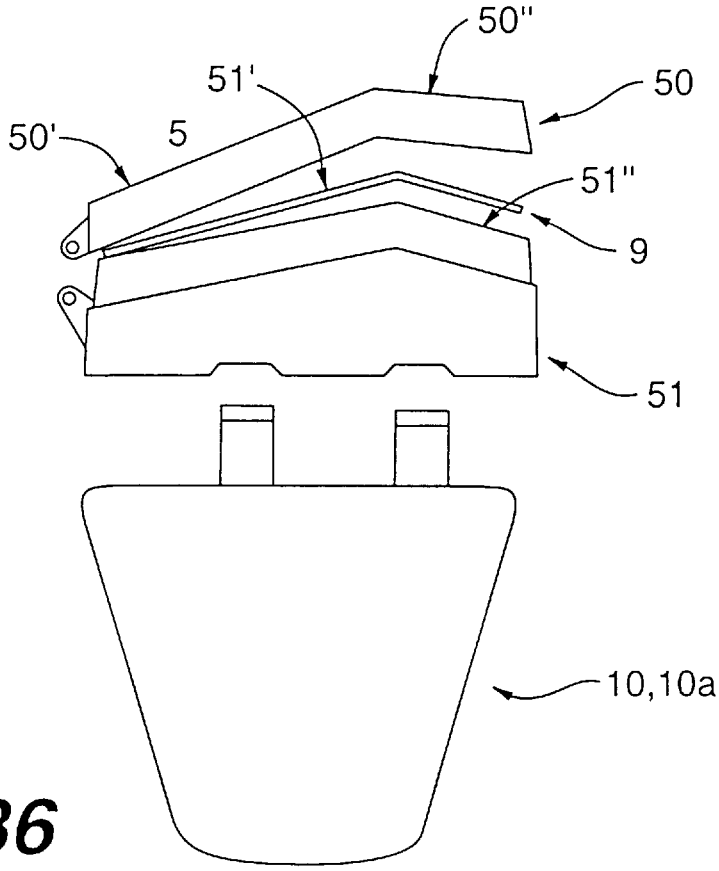
FIG. 36 illustrates a further modification of the two piece carrying body and the top member.

FIGS. 12, 14, 17 and 20, show that both the upper surface of the upper member as well as the top member have a curved configuration along its length. However, it is readily conceivable that the top member, as indicated by reference number 50 in the side view of FIG. 36 could have two substantially planar sections 50' and 50" mutually forming an obtuse angle. Similarly, the upper member, here labeled as 51 can have a top surface of similar configuration seen along its length, i.e. two substantially planar, upper surfaces 51' and 51" forming an obtuse angle. Contrary to prior art carrying bodies for a display apparatus which is removably attachable to the filler gun of a fuel pump, the carrying body, in this particular invention a two-piece carrying body, can be made of a substantially hard plastic material. As an example, a suitable material would be e.g. polyamide. In a prototype, polyamide 66 has proved to be a suitable plastic material.

The top member 27; 34 (37); 49; 50 is suitably made of a substantially hard plastic material which may be transparent or non-transparent. A type of material such as polycarbonate has proved to be suitable in connection with a prototype made of the present apparatus. Suitably, the polycarbonate could be e.g. of the make LEXAN®, MAKROLON®, GRILIAMID® or other suitable make.

In the embodiment of the lower member 10*a* as described in connection with FIGS. 33–35, when the lower member is to be fitted onto the gun head of the filler gun 1, the rear portions of the side panels 12, 13 may be pushed slightly away from each other to more easily push and enter the lower member 10*a* onto the filler gun. Although the lower member is made of a substantially hard plastic material, the wall thickness of the lower member is of such dimension that manipulation of the side panels is possible.

With reference to FIG. 7 of the drawings, and also FIG. 26, and further with reference to FIGS. 13, 16, 19, 21, 22 the upper members 2, 5 shown has a peripheral outline of substantially oval form. Further, the top member also has a peripheral outline of substantially oval form.

Suitable dimensions of the top member in the longitudinal direction are in the range of 110–140 millimeters and a maximum transverse dimension in the range of 80–105 millimeters. Preferably, the longitudinal dimension is in the range of about 120–135 millimeters and the maximum transverse dimension is in the range of about 90–100 millimeters.

With the present invention, it is possible to design a display apparatus having a carrying body with an upper member suitable for any type of filler gun, and a lower member which is selected from a set of lower members, each such lower member being "tailor-made" to fit a particular type or make a filler gun. Thus, use of an upper member having the same display area for all types of filler message guns facilitate standardization of the configuration of the message card.

The two pivotal frame embodiment depicted in FIGS. 37 and 38 offers additional advantages. Opposed first and second frame members engage the protective body and cooperate with one another to form a frame for releasably holding a message card between the frame and the upper surface. This configuration provides for a quick and easy change in message cards. The locking tabs hold the first and second frame members securely together and adjacent the upper surface, and the use of the first and second frame members holds message card 9 securely in position. Moreover, the embodiment of FIG. 39 offers the advantages of maximizing available advertising display surfaces, and also of protecting the advertising text from the elements.

Although preferred embodiments of the present invention have been shown and described, it will be possible for a person skilled in the art to modify the present display apparatus, and the scope of the present invention is therefor only to be limited by the features of the attached patent claims and technical equivalents thereof.

What is claimed is:

1. A display apparatus attachable to a gun head of a fluid filler gun, comprising:

a protective body shaped to generally conform to enclose side, bottom, and upper portions of the gun head, said protective body having an upper surface;

a first frame member pivotally engaged with said protective body and defining a first frame portion, being movable between an open position and a closed position, and capable of covering approximately one half of said upper surface when in the closed position; and a second frame member opposite said first frame member pivotally engaged with said protective body and defining a second frame portion, being movable between an open position and a closed position, and capable, when in the closed position, of covering approximately another half of said upper surface and thereby cooperating with said first frame portion in the closed position to form a single frame over said upper surface for releasably holding a message card between said frame and said upper surface.

2. An apparatus attachable to a gun head of a fluid filler gun, comprising:

a protective body shaped to generally conform to enclose side, bottom, and upper portions of the gun head, said protective body having an upper surface;

a first frame member engaged with said protective body and defining a first frame portion about a portion of said upper surface; and a second frame member opposite said first frame member engaged with said protective body and defining a second frame portion configured to cooperate with said first frame portion to form a frame for releasably holding a message card between said frame and said upper surface, wherein said protective body includes a first member and a second member connected together.

3. The display apparatus of claim 2, wherein said first and second members are releasably engageable with one another.

4. The display apparatus of claim 3, wherein said first member is configured to enclose the bottom portion and side portions of the gun head and said second member is configured to enclose the upper portion of the gun head.

5. An apparatus attachable to a gun head of a fluid filler gun, comprising:

a protective body shaped to generally conform to enclose side, bottom, and upper portions of the gun head, said protective body having an upper surface;

a first frame member engaged with said protective body and defining a first frame portion about a portion of said upper surface;

a second frame member opposite said first frame member engaged with said protective body and defining a second frame portion configured to cooperate with said first frame portion to form a frame for releasably holding a message card between said frame and said upper surface; and a locking tab attached to said first frame member for engaging said first frame member into a recess in said second frame member, thereby forming the frame.

6. An apparatus attachable to a gun head of a fluid filler gun, comprising:

a protective body shaped to generally conform to enclose side, bottom, and upper portions of the gun head, said protective body having an upper surface;

a first frame member engaged with said protective body and defining a first frame portion about a portion of said upper surface;

a second frame member opposite said first frame member engaged with said protective body and defining a second frame portion configured to cooperate with said first frame portion to form a frame for releasably holding a message card between said frame and said upper surface, wherein each of said first and second frame members pivotally engage said protective body at a hinge connection respectively; and a locking tab attached to said first frame member for engaging said first frame member into a recess in said second frame member thereby forming the frame.

7. The display apparatus of claim 6, wherein said locking tab of said first frame member is oriented opposite said hinge connection of said first frame member.

8. The display apparatus of claim 1, wherein said upper surface has an arcuate configuration.

9. The display apparatus of claim 8, wherein said frame has an arcuate configuration.

10. An apparatus attachable to a gun head of a fluid filler gun, comprising:

a protective body shaped to generally conform to enclose side, bottom, and upper portions of the gun head, said protective body having an upper surface;

a first frame member engaged with said protective body and defining a first frame portion about a portion of said upper surface; and a second frame member opposite said first frame member engaged with said protective body and defining a second frame portion configured to cooperate with said first frame portion to form a frame for releasably holding a message card between said frame and said upper surface, wherein said upper surface of said protective body includes an indented portion to ease grasping of the message card for removal from said display apparatus.

11. An apparatus attachable to a gun head of a fluid filler gun, comprising:

a protective body shaped to generally conform to enclose side, bottom, and upper portions of the gun head, said protective body having an upper surface;

a first frame member engaged with said protective body and defining a first frame portion about a portion of said upper surface; and a second frame member opposite said first frame member engaged with said protective body and defining a second frame portion configured to cooperate with said first frame portion to form a frame for releasably holding a message card between said frame and said upper surface, wherein said first and second frame members attach to said protective body with respective first and second spring-loaded hinges.

12. An apparatus attachable to a gun head of a fluid filler gun, comprising:

a protective body shaped to generally conform to enclose side, bottom, and upper portions of the gun head, said protective body having an upper surface;

a first frame member engaged with said protective body and defining a first frame portion about a portion of said upper surface; and a second frame member opposite said first frame member engaged with said protective body and defining a second frame portion configured to cooperate with said first frame portion to form a frame for releasably holding a message card between said frame and said upper surface, wherein said first and second frame members are configured to hold additional message cards.

13. The display apparatus of claims 1, 2, 5, 6, 10, 11, 12, further comprising a latch mechanism adapted to open said first and second frame members.

14. The display apparatus of claim 13, wherein said latch mechanism is adapted to automatically open said first and second frame members upon an operation of the filler gun.

15. The display apparatus of claims 2, 5, 10, 11, 12, wherein said first and second frame members are pivotally engaged with said protective body.

16. A display apparatus attached to a gun head of a fluid filler gun, comprising:

a protective body shaped to generally conform to enclose side, bottom and upper portions of the gun head, said protective body having an upper surface;

a first frame member pivotally engaged with said protective body and defining a first frame portion about a portion of said upper surface;

a second frame member opposite said first frame member pivotally engaged with said protective body and defining a second frame portion configured to cooperate with said first frame portion to form a frame for releasably holding a message card between said frame and said upper surface; and a latch mechanism adapted to open said first and second frame members.

* * * * *

UNITED STATES PATENT AND TRADEMARK OFFICE

CERTIFICATE OF CORRECTION

PATENT NO. : 5,887,367

DATED : March 30,1999

INVENTOR(S) : Stein Alvern

It is certified that error appears in the above-identified patent and that said Letters Patent is hereby corrected as shown below:

Claim 13, Col. 12, Line 41, after "11", insert --or--.

Claim 15, Col. 12, Line 47, after "11", insert --or--.

Signed and Sealed this

Twentieth Day of July, 1999

*Attest:*

*Attesting Officer*

Q. TODD DICKINSON

*Acting Commissioner of Patents and Trademarks*